US012791240B2

(12) United States Patent
Bittner et al.

(10) Patent No.: US 12,791,240 B2
(45) Date of Patent: Nov. 10, 2026

(54) PRECISE ADIABATIC WATER CONTROL

(71) Applicant: Hill Phoenix, Inc., Conyers, GA (US)

(72) Inventors: John D. Bittner, Conyers, GA (US); Jeffrey E. Newel, Snellville, GA (US); Kasra Mohammadi, Conyers, GA (US)

(73) Assignee: Hill Phoenix, Inc., Conyers, GA (US)

( * ) Notice: Subject to any disclaimer, the term of this patent is extended or adjusted under 35 U.S.C. 154(b) by 383 days.

(21) Appl. No.: 18/177,589

(22) Filed: Mar. 2, 2023

(65) Prior Publication Data

US 2024/0295352 A1 Sep. 5, 2024

(51) Int. Cl.
*F25B 49/02* (2006.01)
*F25B 39/02* (2006.01)
*F25B 41/20* (2021.01)

(52) U.S. Cl.
CPC ..... *F25B 49/02* (2013.01); *F25B 39/02* (2013.01); *F25B 41/20* (2021.01); *F25B 2339/02* (2013.01); *F25B 2600/2511* (2013.01)

(58) Field of Classification Search
CPC ..... F25B 49/02; F25B 39/02; F25B 41/20; F25B 2339/02; F25B 2600/2511; F25B 2500/29; F25B 2700/02; F25B 2700/2106; F25B 2700/21161; F25B 49/027; F25B 39/04; F25B 2339/041; G05D 22/00; G05D 7/00
USPC ..... 62/304
See application file for complete search history.

(56) References Cited

U.S. PATENT DOCUMENTS 2,464,766 A * 3/1949 Pennington ..... F24F 6/06 261/92
2,517,998 A * 8/1950 Gilchrist, Jr. ..... F24F 6/04 261/97
2,522,600 A * 9/1950 Brookins ..... F24F 6/04 62/304
2,585,132 A * 2/1952 Kalmadge ..... F24F 6/025 165/47
2,655,795 A * 10/1953 Dyer ..... F25B 39/04 62/305
2,793,015 A * 5/1957 Thompson ..... F24F 5/0035 261/103

(Continued)

FOREIGN PATENT DOCUMENTS

JP 6320071 5/2018
WO WO 2017082714 5/2017
WO WO-2020003324 A1 * 1/2020 ..... F24F 5/0035

OTHER PUBLICATIONS

Electrostatic Spraying Systems, Inc.,—the Technology, copyright 2015, located at http;//maxcharge.com/technology/, 5 pps.

(Continued)

*Primary Examiner* — Eric S Ruppert
*Assistant Examiner* — Kirstin U Oswald
(74) *Attorney, Agent, or Firm* — Fish & Richardson P.C.

(57) ABSTRACT

A method of operating a cooling system having one or more evaporative pads includes: obtaining measurements of one or more ambient conditions associated with the cooling system; determining, based at least in part on at least one of the one or more ambient conditions and one or more characteristics of at least one of the one or more evaporative pads, an available evaporation rate; and controlling, based at least in part on the available evaporation rate, an application rate of water to at least one of the one or more evaporative pads.

31 Claims, 6 Drawing Sheets

(56) References Cited

U.S. PATENT DOCUMENTS 2,805,559 A * 9/1957 Hamilton ..... F24F 1/0038 261/153
3,108,451 A * 10/1963 Clifford ..... F25B 39/04 62/305
3,116,612 A * 1/1964 Pennington ..... F24F 5/0035 62/93
3,260,189 A * 7/1966 Jensen ..... F24C 15/2028 55/DIG. 36
3,362,186 A * 1/1968 Patterson ..... F25D 7/00 62/304
3,669,184 A * 6/1972 Franzreb ..... F24F 5/00 165/47
3,747,362 A * 7/1973 Mercer ..... F24F 1/022 62/309
3,775,993 A * 12/1973 Murphy ..... F28D 5/02 62/304
3,984,995 A * 10/1976 Starr ..... F25D 7/00 62/305
4,004,432 A * 1/1977 Kong ..... F24F 6/04 165/223
4,204,409 A * 5/1980 Satama ..... F24F 5/001 62/271
4,212,172 A * 7/1980 Manno ..... F25D 23/003 62/305
4,380,910 A * 4/1983 Hood ..... F24F 1/0087 62/304
4,479,366 A * 10/1984 Lanier ..... F24F 6/04 261/24
4,548,262 A 10/1985 Hull
4,556,521 A * 12/1985 Baigas, Jr. ..... F24F 6/04 261/106
4,602,487 A * 7/1986 Seeley ..... F24F 6/04 62/304
4,612,778 A * 9/1986 Medrano ..... F24F 6/04 62/304
4,662,902 A 5/1987 Meyer-Pittroff
4,672,820 A * 6/1987 Goettl ..... F24F 6/04 62/304
4,726,197 A * 2/1988 Megrditchian ..... F24F 3/00 62/412
4,730,462 A * 3/1988 Rogers ..... F25D 7/00 62/305
4,815,297 A * 3/1989 Kelley ..... F24F 6/04 62/91
4,833,896 A * 5/1989 Carlson ..... F24F 5/0035 62/304
4,951,480 A * 8/1990 Brence ..... F24F 7/025 62/304
5,003,789 A * 4/1991 Gaona ..... F24F 5/0035 62/304
5,056,593 A 10/1991 Hull
5,121,768 A * 6/1992 Thompson ..... F24F 5/0035 137/391
5,121,770 A * 6/1992 Thompson ..... F24F 5/0035 261/DIG. 46
5,309,726 A * 5/1994 Asbridge ..... F24F 5/0035 62/309
5,349,829 A * 9/1994 Tsimerman ..... F24F 5/0035 261/153
5,695,117 A * 12/1997 Sizemore ..... F24F 5/0035 236/44 A
5,731,081 A * 3/1998 Esu ..... F24F 5/0035 525/162
6,053,482 A 4/2000 Glenn et al.
7,021,070 B2 * 4/2006 Jensen ..... F28D 5/00 62/506
7,150,412 B2 12/2006 Wang et al.
7,310,958 B2 12/2007 Carter et al.
8,033,485 B2 10/2011 Yamaguchi
8,079,898 B1 * 12/2011 Stevenson ..... F24F 13/0218 55/306
8,757,522 B2 6/2014 Tsuji et al.
8,991,203 B2 3/2015 Okabe et al.
9,243,847 B2 * 1/2016 Benz ..... F28F 27/003
9,546,804 B2 1/2017 Troutman et al.
10,132,577 B2 11/2018 Martell et al.
10,619,898 B2 4/2020 Hollander et al.
10,619,953 B2 4/2020 Blay et al.
11,092,394 B2 8/2021 Blay et al.
11,287,165 B2 * 3/2022 Bittner ..... F24F 1/42
2002/0145209 A1 * 10/2002 Litz ..... B60H 1/3202 261/106
2005/0000683 A1 1/2005 Hall et al.
2005/0056042 A1 * 3/2005 Bourne ..... F24F 12/006 62/310
2006/0162354 A1 7/2006 Jensen
2007/0151278 A1 * 7/2007 Jarvis ..... F24F 1/0007 62/310
2008/0018001 A1 * 1/2008 Kammerzell ..... F24F 6/043 62/304
2008/0115921 A1 5/2008 Hall et al.
2009/0030554 A1 * 1/2009 Bean, Jr. ..... H05K 7/20836 62/129
2009/0266516 A1 10/2009 Jewell-Larsen et al.
2010/0162737 A1 7/2010 Hall et al.
2010/0269521 A1 * 10/2010 Moore ..... F28D 9/0025 62/498
2010/0281896 A1 * 11/2010 Al Watban ..... F28D 5/00 62/291
2012/0125027 A1 * 5/2012 Echols ..... F25B 39/04 62/150
2013/0186611 A1 * 7/2013 Schneider ..... F24F 6/043 236/44 A
2013/0264048 A1 10/2013 Matracea et al.
2014/0047858 A1 * 2/2014 Ritchie ..... F28D 5/00 62/314
2014/0263765 A1 9/2014 You et al.
2015/0204626 A1 * 7/2015 Martell ..... F28C 1/14 165/200
2015/0292985 A1 * 10/2015 Yenni ..... G05B 23/0221 702/182
2016/0069577 A1 * 3/2016 Dinnage ..... F28F 19/00 62/333
2016/0252313 A1 9/2016 Ziegltrum
2017/0108251 A1 4/2017 Dinnage
2017/0284691 A1 * 10/2017 Sinha ..... F24F 11/64
2018/0031267 A1 * 2/2018 Hern ..... F25D 21/04
2018/0224174 A1 * 8/2018 Hollander ..... F24F 1/0007
2018/0283814 A1 10/2018 Najafifard
2018/0372387 A1 12/2018 Echols
2019/0376728 A1 * 12/2019 Hayes ..... F25B 9/008
2020/0208887 A1 * 7/2020 Mohammad ..... F25B 39/04
2020/0300553 A1 * 9/2020 Aaron ..... F28F 27/003
2021/0356221 A1 11/2021 Blay et al.
2021/0364198 A1 11/2021 Bittner
2022/0178594 A1 6/2022 Bittner
2022/0192105 A1 * 6/2022 Misner ..... A01G 9/246
2024/0344720 A1 10/2024 Bittner

OTHER PUBLICATIONS

International Preliminary Report on Patentability in International Appln. No. PCT/US2021/033114, dated Dec. 1, 2022, 8 pages.
International Search Report and Written Opinion in International Appln. No. PCT/US2021/033114, dated Sep. 1, 2021, 10 pages.
International Search Report and Written Opinion in International Appln. No. PCT/US2024/018189, dated Jul. 5, 2021, 17 pages.
Singh et al., "Multiejector CO2 cooling system with evaporative gascooler for a supermarket application in tropical regions," Applied Thermal Engineering, Feb. 2021, 190:116766.
Office Action in Mexican Appln. No. MX/a/2022/014519, mailed on Mar. 27, 2026, 8 pages (with English machine translation).

* cited by examiner

PRECISE ADIABATIC WATER CONTROL

TECHNICAL FIELD

The present application relates generally to a refrigeration system with an adiabatic electrostatic cooling device, such as a gas cooler, fluid cooler, or condenser.

BACKGROUND

Refrigeration systems are often used to provide cooling to temperature-controlled display devices (e.g., cases, merchandisers, etc.) in supermarkets and other similar facilities. Vapor compression refrigeration systems are a type of refrigeration system that provide such cooling by circulating a fluid refrigerant (e.g., a liquid and/or vapor) through a thermodynamic vapor compression cycle. In a vapor compression cycle, the refrigerant is typically (1) compressed to a high temperature/pressure state (e.g., by a compressor of the refrigeration system), (2) cooled/condensed to a lower temperature state (e.g., in a gas cooler or condenser which absorbs heat from the refrigerant), (3) expanded to a lower pressure (e.g., through an expansion valve), and (4) evaporated to provide cooling by absorbing heat into the refrigerant.

SUMMARY

The present disclosure describes methods and systems that provide for water flow control based on psychometrics for electrostatic adiabatic evaporation cooling systems and other cooling systems.

Implementations of the present disclosure include a method of operating a cooling system having one or more evaporative pads that includes: obtaining measurements of one or more ambient conditions associated with the cooling system; determining, based at least in part on at least one of the one or more ambient conditions and one or more characteristics of at least one of the one or more evaporative pads, an available evaporation rate; and controlling, based at least in part on the available evaporation rate, an application rate of water to at least one of the one or more evaporative pads.

In some implementations, the method includes controlling the application rate comprises selecting a setpoint for the application rate based at least in part on the available evaporation rate; and adjusting the application rate to maintain the setpoint.

In some implementations, the method includes sensing an airflow through a portion of the cooling system, wherein the evaporation rate is determined, at least in part, based on a rate of the airflow.

In some implementations, the evaporation rate is determined, at least in part, based on an efficiency of at least one of the one or more evaporative pads.

In some implementations, obtaining measurements of the one or more ambient conditions associated with the cooling system includes measuring relative humidity and dry bulb temperature, and the available evaporation rate is determined in part based on the relative humidity and dry bulb temperature.

In some implementations, obtaining measurements of the one or more ambient conditions associated with the cooling system includes receiving weather information data.

In some implementations, the method includes measuring a moisture level associated with at least one of the one or more evaporative pads and adjusting, based at least in part on the measured moisture level, the water application rate.

In some implementations, the method includes measuring a water level associated with run-off from at least one of the one or more evaporative pads and adjusting, based at least in part on the measured water level, the water application rate.

In some implementations, the cooling system includes a $CO_2$ refrigeration system.

In some implementations, the one or more evaporative pads are included in an electrostatic adiabatic cooling system.

In some implementations, the one or more evaporative pads are included in a drip adiabatic cooling system.

In some implementations, the method includes determining a pad efficiency, wherein the available evaporation rate is based at least in part on the pad efficiency.

In some implementations, the method includes adjusting a pad efficiency based on one or more measurements taken during operation of the cooling system, wherein the available evaporation rate is based at least in part on the adjusted pad efficiency.

In some implementations, determining available evaporation rate includes determining, based at least in part of the measured conditions, a humidity ratio for one or more conditions of the cooling system.

In other implementations of the present disclosure, a cooling system includes one or more heat exchanger coils, one or more evaporative pads, one or more nozzle assemblies, one or more ambient sensors, and a controller. The one or more evaporative pads are external to the one or more heat exchanger coils. The one or more nozzle assemblies are external to the one or more evaporative pads and configured to provide water to at least one of the one or more evaporative pads. The one or more ambient sensors are each configured to provide a signal representative of one or more ambient conditions associated with the cooling system. The controller is communicatively coupled to at least one of the one or more ambient sensors. The controller configured to receive the signal representative of at least one of the one or more ambient conditions and control a supply of water to the at least one evaporative pad in response to the signal representative of the one or more ambient conditions.

In some implementations, at least one of the ambient sensors includes a temperature sensor, and the signal is representative of a dry bulb temperature.

In some implementations, at least one of the ambient sensors includes a relative humidity sensor, and the signal is representative of a relative humidity.

In some implementations, the controller is configured to determine, based in part on the dry bulb temperature and the relative humidity, an available evaporation rate for the at least one evaporative pad.

In some implementations, the controller is configured to determine a pad efficiency for the at least one evaporative pad, and the supply of water to the at least one evaporative pad is controlled based in part on the pad efficiency.

In some implementations, the controller is configured to determine, based in part on measured dry bulb temperature, measured relative humidity, and the pad efficiency, an available evaporation rate for the at least one evaporative pad.

In some implementations, the controller is configured to determine an adjustment to a pad efficiency of the at least one evaporative pad based on one or more conditions associated with the cooling system, and the supply of water to the at least one evaporative pad is controlled in part in response to an adjusted pad efficiency.

In some implementations, the system includes a fan configured to move air through at least a portion of the cooling system. An airflow sensor configured to provide a signal representative of an air flow rate is associated with the fan. The supply of water to the at least one evaporative pad is controlled in part in response to the signal representative of the air flow rate.

In some implementations, the controller is configured to determine, based in part on the flow rate, an available evaporation rate for the at least one evaporative pad.

In some implementations, the system includes a moisture sensor configured to provide a signal representative of a moisture level associated with the at least one evaporative pad. The supply of water to at least one evaporative pad is controlled in part in response to the signal representative of the moisture level.

In some implementations, the system includes a weather API coupled to the controller. The controller is configured to control a supply of water to the at least one evaporative pad based in part on weather information received by way of the weather API.

Further implementations of the present disclosure include a method of operating an adiabatic cooling system having one or more evaporative pads that includes: obtaining measurements of one or more ambient conditions associated with the cooling system; determining, based in part on at least one of the one or more ambient conditions and one or more characteristics of at least one of the one or more evaporative pads, an application rate setpoint; and controlling a flow of water to at least one of the one or more evaporative pads to maintain the application rate setpoint.

In some implementations, determining the application rate setpoint includes determining, based at least in part on the ambient conditions, an available evaporation rate at least one of the one or more evaporative pads. The application rate setpoint is determined at least in part from the available evaporation rate.

In some implementations, the characteristics of the pad include an efficiency of the pad.

In some implementations, the method includes sensing an airflow through a portion of the cooling system, wherein the application rate setpoint is determined, at least in part, based on a rate of the airflow.

In some implementations, the one or more ambient conditions include a dry bulb temperature and a relative humidity.

In some implementations, obtaining measurements of the one or more ambient conditions includes receiving weather information data.

Further implementations of the present disclosure includes a method of operating a cooling system having one or more evaporative pads that includes: determining a base efficiency for at least one of the one or more evaporative pads; obtaining measurements of one or more conditions associated with the cooling system while the cooling system is operating; determining, based at least in part on at least one of the measurements of the one or more conditions, one or more adjustments to the base efficiency of at least one of the one or more evaporative pads; determining a current pad efficiency based on the one or more adjustments to the base efficiency; and controlling, based at least in part on the current pad efficiency, an application rate of water to at least one of the one or more evaporative pads.

In some implementations, determining the current pad efficiency includes determining a target pad efficiency.

In some implementations, the method includes determining an available evaporation rate for at least one of the evaporative pads based in part on the current pad efficiency. The application rate of water is controlled based on the available evaporation rate.

Particular implementations of the subject matter described in this specification can be implemented to realize one or more of the following advantages.

Implementations of the present disclosure may avoid overfeeding of pads that result in water being wasted down a sanitation drain or that has to be recirculated.

Implementations of the present disclosure may avoid an underfed pad condition in which water does not properly saturate pad and an effective evaporation rate is not met.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

Figure 1:
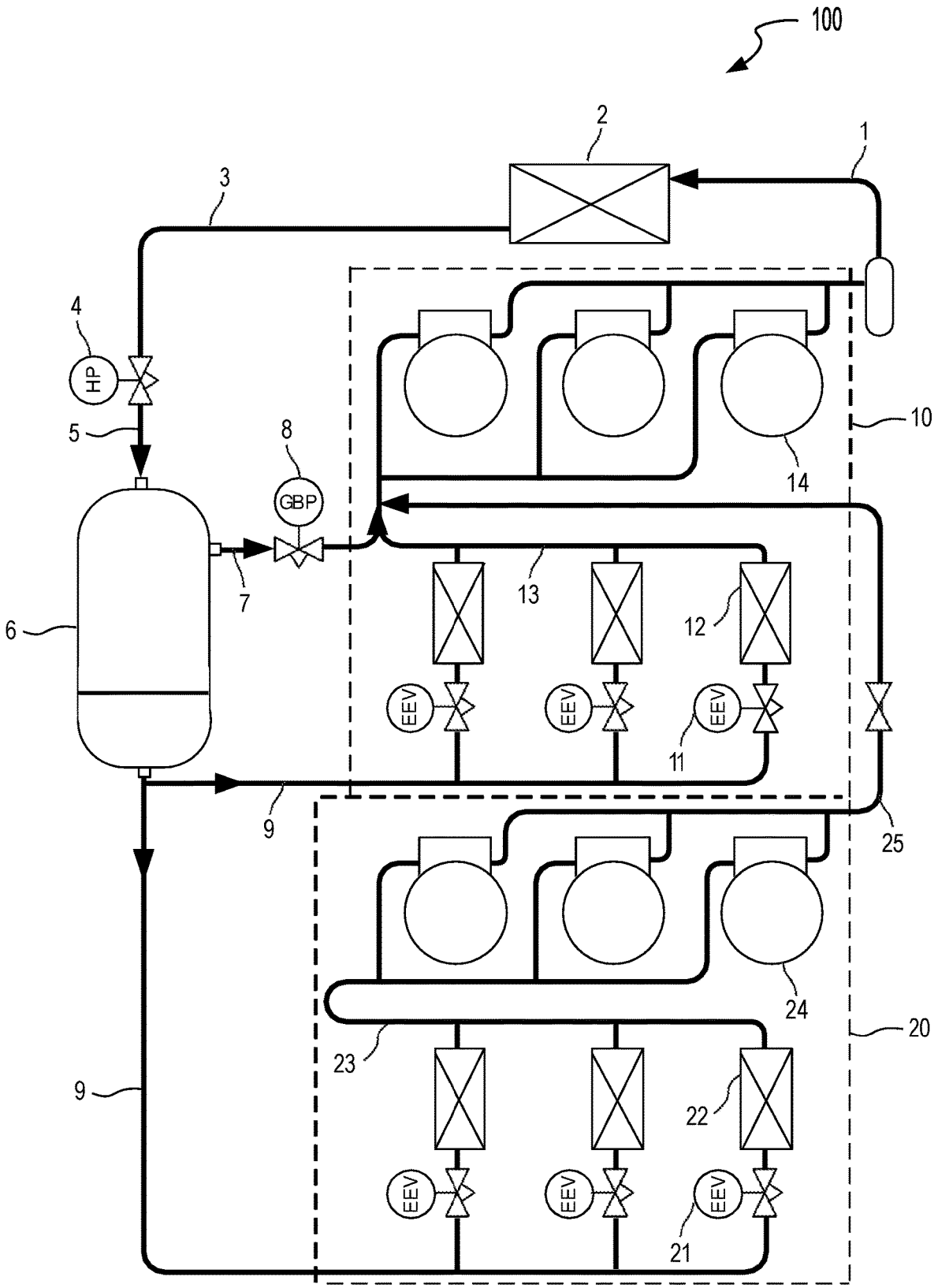
FIG. 1 is a schematic representation of a $CO_2$ refrigeration system having a $CO_2$ refrigeration circuit, a receiving tank for containing a mixture of liquid and vapor $CO_2$ refrigerant, and a gas bypass valve fluidly connected with the receiving tank for controlling a pressure within the receiving tank, according to an exemplary implementation.

In some implementations, a water flow rate from a water source is controlled to supply an amount of water to an adiabatic evaporation pad consistent with the current evaporation rate. Methods and systems described herein may provide for precise water flow control based on psychometrics for the electrostatic adiabatic evaporation cooling systems or other evaporative cooling systems.

In some implementations, a current ambient evaporation rate is calculated based on current relative humidity, current dry bulb temperature, current airflow rate, and the efficiency of the adiabatic pad. These inputs can be used to create a psychrometric model. The model can be used to calculate the precise amount of water that can possibly be evaporated based on the current ambient conditions. The system can provide water flow control via a water regulation valve.

In various implementations, water supply to adiabatic evaporation pads is controlled to prevent overfeed (e.g., runoff wastewater), to prevent overspray (e.g., over-saturating a pad beyond its evaporation capacity), or both.

In some implementations, a real-time weather API is included in a controller for the cooling system. The weather API can collect information that would otherwise be provided by direct relative humidity and dry bulb temperature measurement instruments at or near the location of the cooling system. The weather API data can be used in lieu of relative humidity and dry bulb temperature peripheral input and/or as a back up to the failure of one or more of the direct peripheral devices. In certain implementations, both direct measurements and external weather data (supplied, for example, over a network) are used to control the flow a water to an evaporative cooling system.

The following are more detailed descriptions of various concepts related to, and implementations of, methods, apparatuses, and for providing cooling using an evaporative cooling device. The various concepts introduced above and discussed in greater detail below may be implemented in any number of ways, as the described concepts are not limited to any particular manner of implementation. Examples of specific implementations and applications are provided primarily for illustrative purposes.

Providing a target, such as a temperature-controlled case, with cooling is often performed in order to store products, such as refrigerated goods or frozen goods, in the target. In some applications, the target is cooled by a cooling system that circulates a refrigerant through a circuit path and includes a gas cooler for cooling or condensing a high-temperature refrigerant. The gas cooler may include heat exchanger coils and moisture pads. The moisture pads may be wetted with a device that drips water down through the moisture pads.

In some situations, the cooling systems generate excess water and runoff from the moisture pads that may be drained or recirculated back to drip-emitters at the top of the moisture pads. For example, the water flowing through the moisture pads may not be completely absorbed by the moisture pads or evaporated by the airflow drawn through the pads. As a result, the amount of water necessary for the moisture pads to be adequately wetted and able to provide sufficient cooling may require excess water to flow through the moisture pads. In another situation, spraying water droplets on the moisture pads may cause water to "blow-through" the moisture pad, which decreases efficiency and creates excess runoff, which may result in coil saturation, which leads to formation of scale, corrosion materials, etc.

Implementations described herein are related to a cooling device for a refrigeration system. The cooling device includes a water supply line feeding electrostatic spray nozzles that atomize the water droplets and electrostatically charge the droplets. Electrostatically charging the droplets may provide improved moisture pad coverage and water retention on the moisture pads, as the droplets are capable of being attracted to oppositely charged moisture pads.

Referring generally to the FIGURES, the refrigeration system is shown by way of examples as a $CO_2$ refrigeration system and components thereof, according to various exemplary implementations. The $CO_2$ refrigeration system may be a vapor compression refrigeration system that uses primarily carbon dioxide (i.e., $CO_2$) as a refrigerant. In some implementations, the $CO_2$ refrigeration system may be used to provide cooling for temperature-controlled display devices in a supermarket or other similar facility. The $CO_2$ refrigeration system can include a $CO_2$ refrigerant circuit. The $CO_2$ refrigerant circuit can include evaporators, low-temperature (LT) and medium-temperature (MT) compressors, gas coolers, a receiver, and expansion valves. The $CO_2$ refrigerant circuit can be configured to circulate $CO_2$ as a refrigerant to provide cooling to the evaporators.

In some implementations, the $CO_2$ refrigeration system includes a receiving tank (e.g., a flash tank, a refrigerant reservoir, etc.) containing a mixture of $CO_2$ liquid and $CO_2$ vapor, a gas bypass valve, and a parallel compressor. The gas bypass valve may be arranged in series with one or more MT compressors of the $CO_2$ refrigeration system. The gas bypass valve provides a mechanism for controlling the $CO_2$ refrigerant pressure within the receiving tank by venting excess $CO_2$ vapor to the suction side of the $CO_2$ refrigeration system MT compressors. The parallel compressor may be arranged in parallel with both the gas bypass valve and with other compressors of the $CO_2$ refrigeration system. The parallel compressor provides an alternative or supplemental means for controlling the pressure within the receiving tank.

Advantageously, the $CO_2$ refrigeration system includes a controller for monitoring and controlling the pressure, temperature, and/or flow of the $CO_2$ refrigerant throughout the $CO_2$ refrigeration system. The controller can operate both the gas bypass valve and the parallel compressor (e.g., according to the various control processes described herein) to efficiently regulate the pressure of the $CO_2$ refrigerant within the receiving tank. Additionally, the controller can interface with other instrumentation associated with the $CO_2$ refrigeration system (e.g., measurement devices, timing devices, pressure sensors, temperature sensors, etc.). The controller can provide appropriate control signals to a variety of operable components of the $CO_2$ refrigeration system (e.g., compressors, valves, power supplies, flow diverters, etc.) to regulate the pressure, temperature, and/or flow at other locations within the $CO_2$ refrigeration system. Advantageously, the controller may be used to facilitate efficient operation of the $CO_2$ refrigeration system, reduce energy consumption, and improve system performance.

Before discussing further details of the $CO_2$ refrigeration system and/or the components thereof, it should be noted that references to "front," "back," "rear," "upward," "downward," "inner," "outer," "right," and "left" in this description are merely used to identify the various elements as they are oriented in the Figures. These terms are not meant to limit the element that they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, transmission of forces, electrical signals, or other types of signals or communication between the two members. Such joining may be achieved with the two members, or the two members and any additional intermediate members being integrally formed as a single unitary body with one another or with the two members or the two members and any additional intermediate members being attached to one another. Such joining may be permanent in nature or alternatively may be removable or releasable in nature.

Referring now to FIG. 1, a $CO_2$ refrigeration system 100 is shown according to an exemplary implementation. According to other implementations, the refrigeration system may be configured to use other refrigerants, such as hydrofluorocarbons, ammonia, etc., and associate cooling device such as condensers, fluid coolers, etc. The illustrated $CO_2$ refrigeration system 100 may be a vapor compression refrigeration system that uses primarily $CO_2$ as a refrigerant. $CO_2$ refrigeration system 100 and is shown to include a system of pipes, conduits, or other fluid channels (e.g., fluid conduits 1, 3, 5, 7, and 9) for transporting the $CO_2$ between various thermodynamic components of the refrigeration system. The thermodynamic components of $CO_2$ refrigeration system 100 are shown to include a gas cooler/condenser 2, a high-pressure valve 4, a receiving tank 6, a gas bypass valve 8, a medium-temperature ("MT") system portion 10, and a low-temperature ("LT") system portion 20.

Gas cooler/condenser 2 may be a heat exchanger, fan-coil unit, or other similar device for removing heat from the $CO_2$ refrigerant. According to other implementations that may use different refrigerants, the gas cooler/condenser may be a fluid cooler or condensing unit. Gas cooler/condenser 2 is shown receiving $CO_2$ vapor from fluid conduit 1. In some implementations, the $CO_2$ vapor in fluid conduit 1 may have a pressure within a range from approximately 45 bar to approximately 100 bar (i.e., about 640 psig to about 1420 psig), depending on ambient temperature and other operating conditions. In some implementations, gas cooler/condenser 2 may partially or fully condense $CO_2$ vapor into liquid $CO_2$ (e.g., if system operation is in a subcritical region). The condensation process may result in fully saturated $CO_2$ liquid or a liquid-vapor mixture (e.g., having a thermodynamic quality between 0 and 1). In other implementations, gas cooler/condenser 2 may cool the $CO_2$ vapor (e.g., by removing superheat) without condensing the $CO_2$ vapor into $CO_2$ liquid (e.g., if system operation is in a supercritical region). In some implementations, the cooling/condensation process is an isobaric process. Gas cooler/condenser 2 is shown outputting the cooled and/or condensed $CO_2$ refrigerant into fluid conduit 3. The gas cooler/condenser 2 may include the evaporative gas cooler described herein.

High-pressure valve 4 receives the cooled and/or condensed $CO_2$ refrigerant from fluid conduit 3 and outputs the $CO_2$ refrigerant to fluid conduit 5. High-pressure valve 4 may control the pressure of the $CO_2$ refrigerant in gas cooler/condenser 2 by controlling an amount of $CO_2$ refrigerant permitted to pass through high-pressure valve 4. In some implementations, high-pressure valve 4 is a high-pressure thermal expansion valve (e.g., if the pressure in fluid conduit 3 is greater than the pressure in fluid conduit 5). In such implementations, high-pressure valve 4 may allow the $CO_2$ refrigerant to expand to a lower pressure state. The expansion process may be an isenthalpic and/or adiabatic expansion process, resulting in a flash evaporation of the high-pressure $CO_2$ refrigerant to a lower pressure, lower temperature state. The expansion process may produce a liquid/vapor mixture (e.g., having a thermodynamic quality between 0 and 1). In some implementations, the $CO_2$ refrigerant expands to a pressure of approximately 38 bar (e.g., about 540 psig), which corresponds to a temperature of approximately 37° F. The $CO_2$ refrigerant then flows from fluid conduit 5 into receiving tank 6.

Receiving tank 6 (e.g., receiver, receiver tank, etc.) collects the $CO_2$ refrigerant from fluid conduit 5. In some implementations, receiving tank 6 may be a flash tank or other fluid reservoir. Receiving tank 6 includes a $CO_2$ liquid portion and a $CO_2$ vapor portion and may contain a partially saturated mixture of $CO_2$ liquid and $CO_2$ vapor. In some implementations, receiving tank 6 separates the $CO_2$ liquid from the $CO_2$ vapor. The $CO_2$ liquid may exit receiving tank 6 through fluid conduits 9. Fluid conduits 9 may be liquid headers leading to either MT system portion 10 or LT system portion 20. The $CO_2$ vapor may exit receiving tank 6 through fluid conduit 7. Fluid conduit 7 is shown leading the $CO_2$ vapor to gas bypass valve 8.

Gas bypass valve 8 is shown receiving the $CO_2$ vapor from fluid conduit 7 and outputting the $CO_2$ refrigerant to MT system portion 10. In some implementations, gas bypass valve 8 may be operated to regulate or control the pressure within receiving tank 6 (e.g., by adjusting an amount of $CO_2$ refrigerant permitted to pass through gas bypass valve 8). For example, gas bypass valve 8 may be adjusted (e.g., variably opened or closed) to adjust the mass flow rate, volume flow rate, or other flow rates of the $CO_2$ refrigerant through gas bypass valve 8. Gas bypass valve 8 may be opened and closed (e.g., manually, automatically, by a controller, etc.) as needed to regulate the pressure within receiving tank 6.

In some implementations, gas bypass valve 8 includes a sensor for measuring a flow rate (e.g., mass flow, volume flow, etc.) of the $CO_2$ refrigerant through gas bypass valve 8. In other implementations, gas bypass valve 8 includes an indicator (e.g., a gauge, a dial, etc.) from which the position of gas bypass valve 8 may be determined. This position may be used to determine the flow rate of $CO_2$ refrigerant through gas bypass valve 8, as such quantities may be proportional or otherwise related.

In some implementations, gas bypass valve 8 may be a thermal expansion valve (e.g., if the pressure on the downstream side of gas bypass valve 8 is lower than the pressure in fluid conduit 7). According to one implementation, the pressure within receiving tank 6 is regulated by gas bypass valve 8 to a pressure of approximately 38 bar, which corresponds to about 37° F. Advantageously, this pressure/temperature state (i.e., approximately 38 bar, approximately 37° F.) may facilitate the use of copper tubing/piping for the downstream $CO_2$ lines of the system. Additionally, this pressure/temperature state may allow such copper tubing to operate in a substantially frost-free manner.

Still referring to FIG. 1, MT system portion 10 is shown to include one or more expansion valves 11, one or more MT evaporators 12, and one or more MT compressors 14. In various implementations, any number of expansion valves 11, MT evaporators 12, and MT compressors 14 may be present. Expansion valves 11 may be electronic expansion valves or other similar expansion valves. Expansion valves 11 are shown receiving liquid $CO_2$ refrigerant from fluid conduit 9 and outputting the $CO_2$ refrigerant to MT evaporators 12. Expansion valves 11 may cause the $CO_2$ refrigerant to undergo a rapid drop in pressure, thereby expanding the $CO_2$ refrigerant to a lower pressure, lower temperature state. In some implementations, expansion valves 11 may expand the $CO_2$ refrigerant to a pressure of approximately 30 bar. The expansion process may be an isenthalpic and/or adiabatic expansion process.

MT evaporators 12 are shown receiving the cooled and expanded $CO_2$ refrigerant from expansion valves 11. In some implementations, MT evaporators may be associated with display cases/devices (e.g., if $CO_2$ refrigeration system 100 is implemented in a supermarket setting). MT evaporators 12 may be configured to facilitate the transfer of heat from the display cases/devices into the $CO_2$ refrigerant. The added heat may cause the $CO_2$ refrigerant to evaporate partially or completely. According to one implementation, the $CO_2$ refrigerant is fully evaporated in MT evaporators 12. In some implementations, the evaporation process may be an isobaric process. MT evaporators 12 are shown outputting the $CO_2$ refrigerant via fluid conduits 13, leading to MT compressors 14.

MT compressors 14 compress the $CO_2$ refrigerant into a superheated vapor having a pressure within a range of approximately 45 bar to approximately 100 bar. The output pressure from MT compressors 14 may vary depending on ambient temperature and other operating conditions. In some implementations, MT compressors 14 operate in a transcritical mode. In operation, the $CO_2$ discharge gas exits MT compressors 14 and flows through fluid conduit 1 into gas cooler/condenser 2.

Still referring to FIG. 1, LT system portion 20 is shown to include one or more expansion valves 21, one or more LT evaporators 22, and one or more LT compressors 24.

In various implementations, any number of expansion valves 21, LT evaporators 22, and LT compressors 24 may be present. In some implementations, LT system portion 20 may be omitted and the $CO_2$ refrigeration system 100 may operate with an air conditioning (AC) module interfacing with only MT system 10.

Expansion valves 21 may be electronic expansion valves or other similar expansion valves. Expansion valves 21 are shown receiving liquid $CO_2$ refrigerant from fluid conduit 9 and outputting the $CO_2$ refrigerant to LT evaporators 22. Expansion valves 21 may cause the $CO_2$ refrigerant to undergo a rapid drop in pressure, thereby expanding the $CO_2$ refrigerant to a lower pressure, lower temperature state. The expansion process may be an isenthalpic and/or adiabatic expansion process. In some implementations, expansion valves 21 may expand the $CO_2$ refrigerant to a lower pressure than expansion valves 11, thereby resulting in a lower temperature $CO_2$ refrigerant. Accordingly, LT system portion 20 may be used in conjunction with a freezer system or other lower temperature display cases.

LT evaporators 22 are shown receiving the cooled and expanded $CO_2$ refrigerant from expansion valves 21. In some implementations, LT evaporators may be associated with display cases/devices (e.g., if $CO_2$ refrigeration system 100 is implemented in a supermarket setting). LT evaporators 22 may be configured to facilitate the transfer of heat from the display cases/devices into the $CO_2$ refrigerant. The added heat may cause the $CO_2$ refrigerant to evaporate partially or completely. In some implementations, the evaporation process may be an isobaric process. LT evaporators 22 are shown outputting the $CO_2$ refrigerant via fluid conduit 23, leading to LT compressors 24.

LT compressors 24 compress the $CO_2$ refrigerant. In some implementations, LT compressors 24 may compress the $CO_2$ refrigerant to a pressure of approximately 30 bar (e.g., about 425 psig) having a saturation temperature of approximately 23° F. (e.g., about −5° C.). LT compressors 24 are shown outputting the $CO_2$ refrigerant through fluid conduit 25. Fluid conduit 25 may be fluidly connected with the suction (e.g., upstream) side of MT compressors 14.

In some implementations, the $CO_2$ vapor that is bypassed through gas bypass valve 8 is mixed with the $CO_2$ refrigerant gas exiting MT evaporators 12 (e.g., via fluid conduit 13). The bypassed $CO_2$ vapor may also mix with the discharge $CO_2$ refrigerant gas exiting LT compressors 24 (e.g., via fluid conduit 25). The combined $CO_2$ refrigerant gas may be provided to the suction side of MT compressors 14.

Figure 2:
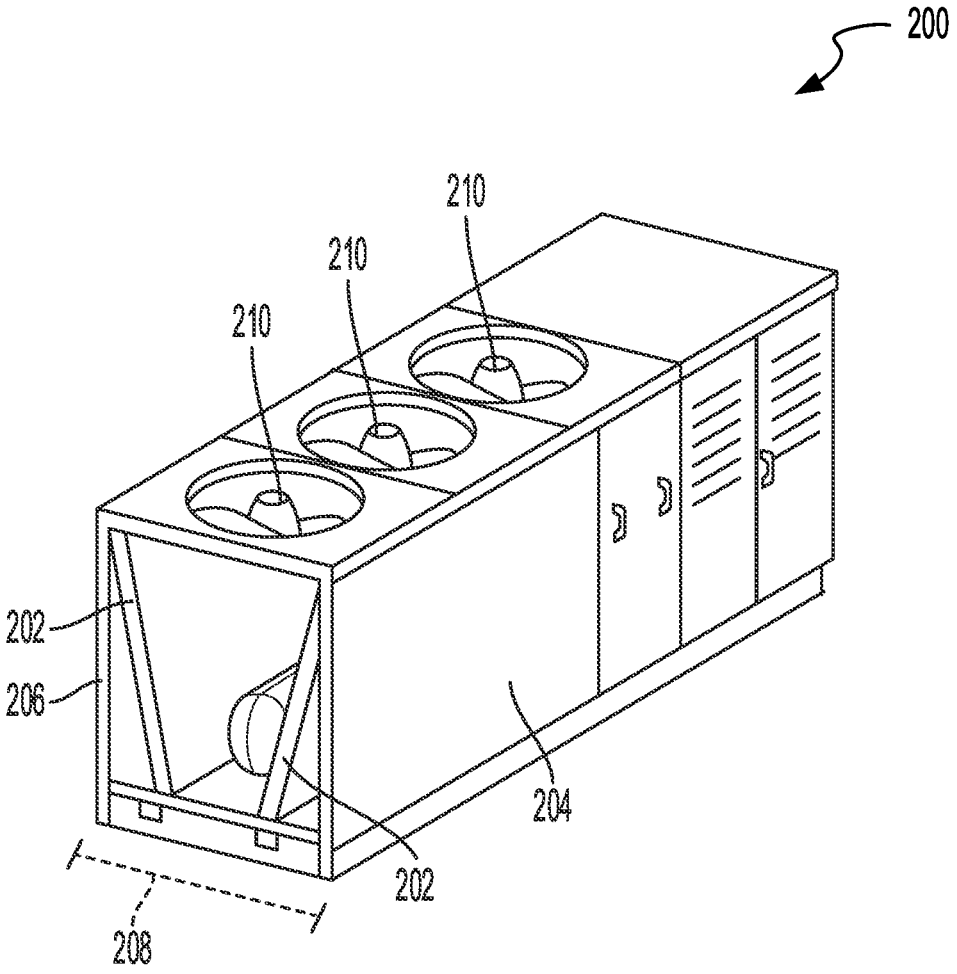
FIG. 2 is a schematic representation of an adiabatic gas cooler, according to an exemplary implementation.

Referring now to FIG. 2, a refrigerant cooling device shown as a gas cooler 200 (e.g., adiabatic gas cooler, evaporative gas cooler, adiabatic gas condenser, evaporative gas condenser, gas condenser, etc.) is shown according to an exemplary implementation. The gas cooler 200 can include the gas cooler/condenser 2 described above. The gas cooler 200 may include one or more heat exchanger coils 202. For example, the heat exchanger coil 202 can include a coil, microchannel coil, condenser coil, tube coil, cooling coil, or fin coil. The heat exchanger coil 202 can include multiple tubes through which refrigerant flows. The heat exchanger coil 202 can receive ambient cool air drawn over the heat exchanger coil 202 by a fan. According to one implementation, the gas cooler 200 may include a plurality of heat exchanger coils 202. The heat exchanger coil 202 may be arranged in a "V" shape.

To enhance the cooling efficiency of heat exchanger coils 202, the gas cooler 200 (or, in some systems, a condenser) may include one or more moisture panels such as a first moisture panel 204 and a second moisture panel 206. The first moisture panel 204 can be disposed external to the heat exchanger coils 202. The first moisture panel 204 man include one or more evaporative pads. The evaporative pads may be an adiabatic pad. The first moisture panel 204 may be used to generate pre-cooled air by an evaporative cooling process. For example, ambient air may pass through the first moisture panel 204 before the ambient air passes through the heat exchanger coils 202. As the ambient air passes through the first moisture panel 204, the ambient air cools as the moisture in the first moisture panel 204 evaporates and becomes pre-cooled air. The gas cooler 200 may include one or more moisture pads adjacent to the one or more cooling coils. For example, a plurality of moisture pads can be disposed adjacent to a plurality of cooling coils. According to the illustrated implementation of FIG. 2, the first moisture panel 204 is disposed outwardly and co-extensively with each heat exchanger coil 202. The first moisture panel 204 can provide an evaporative cooling effect when air is drawn through the first moisture panel 204. The first moisture panel 204 can increase the cooling efficiency of the heat exchanger coils 202.

In addition, the gas cooler 200 may include a second moisture panel 206 (e.g., second adiabatic panel, second adiabatic pad, second adiabatic moisture pad, second moisture pad, second cooling pad, etc.) disposed external to the heat exchanger coils 202. The second moisture panel 206 may be used to generate pre-cooled air by an evaporative cooling process. For example, ambient air may pass through the second moisture panel 206 before the ambient air passes through the heat exchanger coils 202. As the ambient air passes through the second moisture panel 206, the ambient air cools as the moisture in the second moisture panel 206 evaporates and becomes pre-cooled air. According to the illustrated implementation of FIG. 2, the second moisture panel 206 is disposed outwardly and co-extensively with each heat exchanger coil 202. The second moisture panel 206 can provide an evaporative cooling effect when air is drawn through the second moisture panel 206. The second moisture panel 206 can increase the cooling efficiency of the heat exchanger coils 202.

The second moisture panel 206 can be separated from the first moisture panel 204 by a distance 208. For example, the first moisture panel 204 can be separated from the second moisture panel 206 by a distance 208 at a base of the first moisture panel 204 and a base of the second moisture panel 206. The first moisture panel 204 can be separated from the second moisture panel 206 by a distance 208 at a center of the first moisture panel 204 and a center of the second moisture panel 206. The first moisture panel 204 can be separated from the second moisture panel 206 by a distance 208 at a top of the first moisture panel 204 and a top of the second moisture panel 206.

The gas cooler 200 may also include one or more fans 210. The fans 210 draw ambient air or pre-cooled air through the heat exchanger coils 202, thereby cooling and condensing the refrigerant and providing cooling to the $CO_2$ refrigeration system 100. The gas cooler 200 may include one or more motors that power the fans 210. The fans 210 draw air through moisture panels and subsequently through the heat exchanger coils 202. The fans 210 are shown located above the heat exchanger coils 202. The first moisture panel 204 can provide an evaporative cooling effect to the heat exchanger coil 202 when air is drawn through the first moisture panel 204 by the fans 210. The second moisture panel 206 can provide an evaporative cooling effect to the heat exchanger coil 202 when air is drawn through the second moisture panel 206 by the fans 210.

Figure 3:
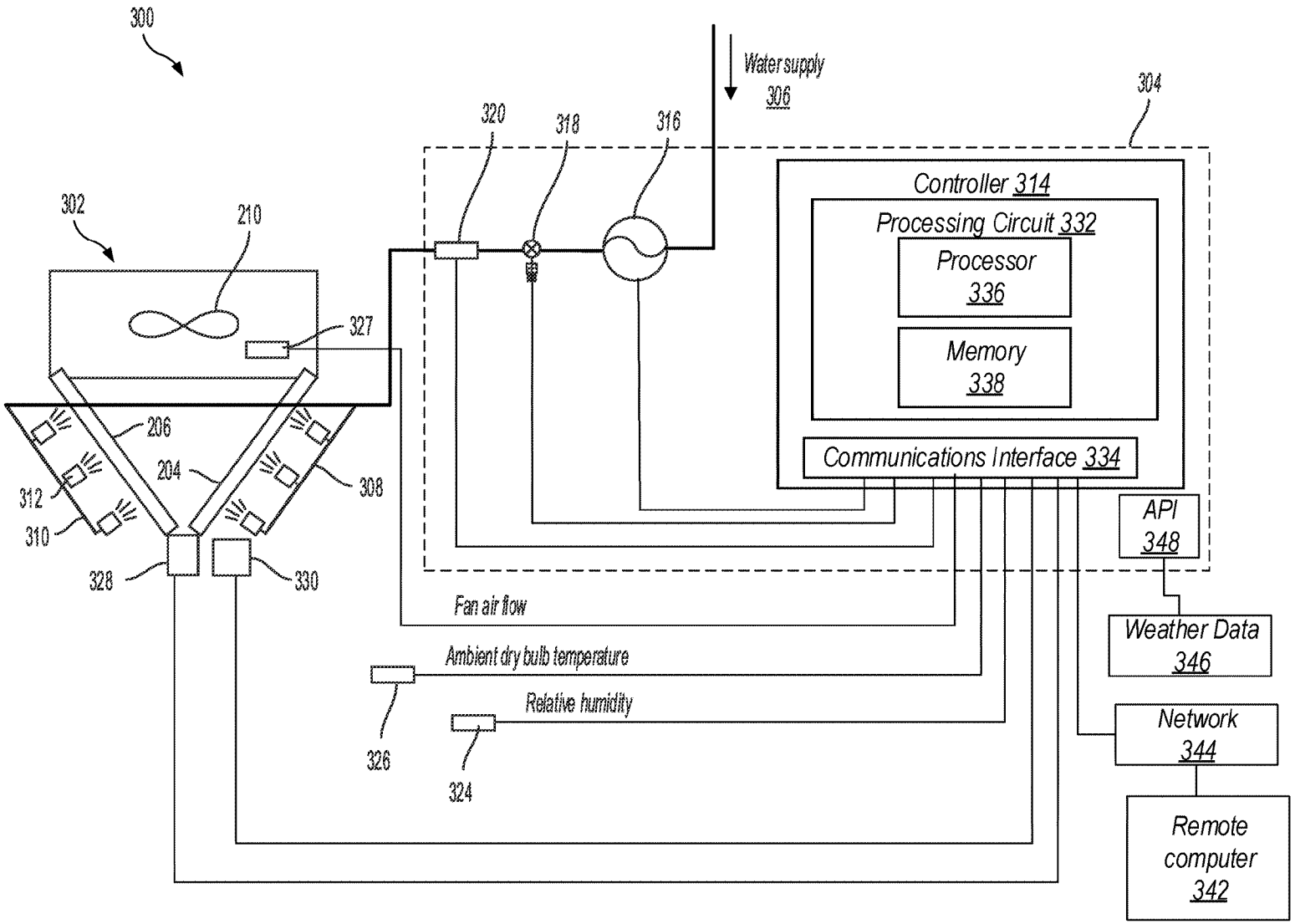
FIG. 3 is a schematic representation of a cross-section of an adiabatic gas cooler, according to an exemplary implementation.

Referring now to FIG. 3, a cooling system 300 is shown according to an exemplary implementation. Cooling system 300 includes gas cooler unit 302 and control system 304. Control system 304 controls the flow of water to gas cooler unit 302 from water supply 306.

Gas cooler unit 302 includes a first nozzle array 308 (e.g., first water spray nozzle array, one or more spray nozzles, etc.). The first nozzle array 308 can be disposed external to the first moisture panel 204. For example, the first nozzle array 308 can be located on the exterior of the first moisture panel 204. The first nozzle array 308 can be configured to provide an atomized spray of electrostatically charged water droplets to the first moisture panel 204. The atomized spray of electrostatically charged water droplets and the first moisture panel 204 are oppositely charged. For example, the first nozzle array 308 can include nozzles, each of which can include a barrel. An electrical charge can be applied to the barrel of each of the nozzles, which applies a charge to the fluid (e.g., water) and/or water droplets. As the fluid is propelled through the nozzle, the water gains an electric charge. For example, the barrel of the nozzle can transfer a negative charge to the droplets (e.g., water droplets, etc.). The first moisture panel 204 can be positively charged (or grounded) to create an attractive force to the droplets. The positively charged first moisture panel 204 can create an attraction to the negatively charged droplets. Alternatively, the barrel of the nozzle can transfer a positive charge to the droplets (e.g., water droplets, etc.) and the first moisture panel 204 can be negatively charged (or grounded). The negatively charged first moisture panel 204 can create an attraction to the positively charged droplets. Electrostatically spraying droplets onto the first moisture panel 204 can allow more water to land on the charged first moisture panel 204. Electrostatically spraying droplets onto the first moisture panel 204 can allow more water to be retained by the first moisture panel 204. Due to the charge, when the water leaves the nozzle, the water is attracted to the first moisture panel 204 and "sticks" (e.g., wets, adheres, etc.) to the first moisture panel 204. The attraction improves coverage of wetting on the moisture panels and minimizes dry spots. The attraction also improves the water efficiency by more effectively covering the surface that results in less water usage. The attraction further reduces "blow-through" of moisture through the moisture panels. For example, the electrostatic attraction of the atomized spray of electrostatically charged droplets and the moisture panels substantially prevents blow-through of droplets beyond an inside surface of the moisture panel.

The gas cooler unit 302 also includes a second nozzle array 310 (e.g., second water spray nozzle array, one or more spray nozzles, etc.). The second nozzle array 310 can be disposed external to the second moisture panel 206. For example, the second nozzle array 310 can be located on the exterior of the second moisture panel 206. The second nozzle array 310 can be configured to provide an atomized spray of electrostatically charged water droplets to the second moisture panel 206. The atomized spray of electrostatically charged water droplets and the second moisture panel 206 are oppositely charged. For example, the second nozzle array 310 can include nozzles, each of which can include a barrel. An electrical charge can be applied to the barrel of each of the nozzles, which applies a charge to the fluid (e.g., water) and/or water droplets. As the fluid is propelled through the nozzle, the water gains an electric charge. For example, the barrel of the nozzle can transfer a negative charge to the droplets (e.g., water droplets, etc.). The second moisture panel 206 can be positively charged (or grounded) to create an attractive force to the droplets. The positively charged second moisture panel 206 can create an attraction to the negatively charged droplets. Alternatively, the barrel of the nozzle can transfer a positive charge to the droplets (e.g., water droplets, etc.) and the second moisture panel 206 can be negatively charged (or grounded). The negatively charged second moisture panel 206 can create an attraction to the positively charged droplets. Electrostatically spraying droplets onto the second moisture panel 206 can allow more water to land on the charged second moisture panel 206. Electrostatically spraying droplets onto the first moisture panel 204 can allow more water to be retained by the second moisture panel 206. Due to the charge, when the water leaves the nozzle, the water is attracted to the second moisture panel 206 and "sticks" (e.g., wets, adheres, etc.) to the second moisture panel 206. In some implementations, the first nozzle array 308 and the second nozzle array 310 form a single nozzle array.

Control system 304 includes controller 314, pump 316, control valve 318, and water flow sensor 320. Controller 314 is coupled pump 316, control valve 318, and water flow sensor 320. Control system is coupled to relative humidity sensor 324, ambient dry bulb temperature sensor 326, overflow pan level sensor 328, and moisture sensor 330. Controller 314 can use signals from relative humidity sensor 324, ambient dry bulb temperature sensor 326, airflow sensor 327, overflow pan level sensor 328, moisture sensor 330 to operate pump 316 and control valve 318 to regulate a flow a water to gas cooler unit 302. In some implementations, a system does not include a pump. For example, in some installations, water supply pressure may be sufficient. In some cases, a fan speed signal is sent by an external controller (e.g., a 0-10 VDC signal can be intercepted to use for this purpose).

In some implementations, a system includes multiple control valves. The valve(s) can be controlled, for example, by an analog signal (e.g., 4-20 mA, 0-10 VDC) representing percentage open to position it directly or if using a stepper valve, through a stepper driver. Alternatively, water flow can be controlled using a pulse width modulation (PWM) approach and simple solenoid valves (a single valve or individual nozzle valves). In this case, the requested percentage open can be equivalent to the percentage of the PWM period.

In certain implementations, a moisture sensor (e.g., moisture sensor 330) is used for predictive assessments and accuracy, with or without being used for control.

Controller 314 may receive signals from one or more measurement devices (e.g., pressure sensors, temperature sensors, flow sensors, etc.) located within system 300. For example, controller 314 is shown receiving measurements from relative humidity sensor 324, ambient dry bulb temperature sensor 326, airflow sensor 327, overflow pan level sensor 328, and moisture sensor 330. Controller 314 may use the input signals to determine appropriate control actions for controllable devices of a system (e.g., compressors, pumps, valves, etc.).

In some implementations, controller 314 is configured to operate control valve 318 at a desired setpoint or within a desired range. In some implementations, controller 314 operates high-pressure valves and expansion valves of MT subsystem, LT subsystem, and primary subsystem to regulate the flow of refrigerant and various sub-systems of a system (e.g., system 100 shown in FIG. 1).

Controller 314 may include feedback control functionality for adaptively operating the various components of cooling system 300. For example, controller 314 may receive a setpoint (e.g., a level setpoint, a temperature setpoint, a pressure setpoint, a flow rate setpoint, a power usage setpoint, etc.) and operate one or more components of system 300 to achieve the setpoint. The setpoint may be specified by a user (e.g., via a user input device, a graphical user interface, a local interface, a remote interface, etc.) or automatically determined by controller 314 based on a history of data measurements.

Controller 314 may be a proportional-integral (PI) controller, a proportional-integral-derivative (PID) controller, a pattern recognition adaptive controller (PRAC), a model recognition adaptive controller (MRAC), a model predictive controller (MPC), or any other type of controller employing any type of control functionality. In some implementations, controller 314 is a local controller for cooling system 300. In other implementations, controller 314 is a supervisory controller for a plurality of controlled subsystems (e.g., a refrigeration system, an AC system, a lighting system, a security system, etc.). For example, controller 314 may be a controller for a comprehensive building management system incorporating system 300. Controller 314 may be implemented locally, remotely, or as part of a cloud-hosted suite of building management applications.

Controller 314 includes a processing circuit 332. Processing circuit 332 is shown to include a processor 336 and memory 338. Processor 336 can be implemented as a general purpose processor, an application specific integrated circuit (ASIC), one or more field programmable gate arrays (FPGAs), a group of processing components, a microcontroller, or other suitable electronic processing components. Memory 338 (e.g., memory device, memory unit, storage device, etc.) may be one or more devices (e.g., RAM, ROM, solid state memory, hard disk storage, etc.) for storing data and/or computer code for completing or facilitating the various processes, layers and modules described in the present application. Memory 338 may be or include volatile memory or non-volatile memory. Memory 338 may include database components, object code components, script components, or any other type of information structure for supporting the various activities and information structures described in the present application. According to an exemplary implementation, memory 338 is communicably connected to processor 336 via processing circuit 332 and includes computer code for executing (e.g., by processing circuit 332 and/or processor 336) one or more processes or control features described herein.

Controller 314 includes a communications interface 334. Communications interface 334 can be or include wired or wireless interfaces (e.g., jacks, antennas, transmitters, receivers, transceivers, wire terminals, etc.) for conducting electronic data communications. Data communications may be conducted via a direct connection (e.g., a wired connection, an ad-hoc wireless connection, etc.) or a network connection (e.g., an Internet connection, a LAN, WAN, or WLAN connection, etc.). For example, communications interface 334 can include an Ethernet card and port for sending and receiving data via an Ethernet-based communications link or network. In some implementations, a network interface controller facilitates communication of the controller 314 with other devices (for example, external monitoring devices and/or sensors) over one or more wired or wireless networks, such remote device 342 via network 344.

In one example, communications interface 334 includes a Wi-Fi transceiver or a cellular or mobile phone transceiver for communicating via a wireless communications network.

Computations and analysis based on the sensor data can be performed at least partly by processing circuit 332, e.g., by processes that execute on the processor 336. In some implementations, computation and analysis of sensor data is performed by one or more computing systems coupled to controller 314, such as a remote device 342 connected to controller 314 over a network 344.

Controller 314 is coupled to weather data source 346 by way of API (application program interface) 348. In some implementations, API 348 is a real-time weather data API embedded into controller 314. Weather data source 346 provides current weather data associated with the location of cooling system 300. The weather information can include ambient dry bulb temperature and humidity data. Weather data from an external data source can be used in addition to, or in lieu of, sensor data from relative humidity sensor 324, ambient dry bulb temperature sensor 326, or both.

In some implementations, information associated with ambient conditions measured by sensors and airflow rate are used by control system 304 to control water flow to cooling unit 302 based on an evaporation rate. In one implementation, controller 314 receives signals from relative humidity sensor 324, ambient dry bulb temperature sensor 326, and airflow sensor 327. From the signals received from the sensors, controller 314 determines an available evaporation rate for one or more of first moisture panel 204 and second moisture panel 206.

Controller 314 can be configured to control a supply of water to at least one of the first moisture panel 204 or the second moisture panel 206 (e.g., individually or in combination) in response to water flow rate signals. For example, the controller 314 can be configured to control a supply of water to the first moisture panel 204 and the second moisture panel 206 in response to the signal representative of a setpoint water flow rate. For example, the controller 314 can decrease the supply of water to the one or more moisture pads in response to a signal that the flow rate is higher than a setpoint level. The controller 314 can increase the supply of water to the one or more moisture pads in response to a signal that the flow rate is lower than the setpoint level. The controller 314 can retain (e.g., maintain, hold constant) the supply of water to the moisture pads in response to a signal that the flow rate is at the setpoint.

The controller 314 can be configured to control the supply of water using a variable rate controller (e.g., flow control valve, etc.). For example, the variable rate controller can adjust the application rate of droplets to an optimal amount for each moisture panel or for a single moisture panel. For example, the variable rate controller can provide a higher application rate of droplets to the first moisture panel 204 than to the second moisture panel 206, or vice versa.

In some implementations, the controller 314 can be configured to supply a voltage to the nozzles of the first nozzle array 308 and the second nozzle array 310. The controller 314 can select the voltage so as to cause the first nozzle array 308 and the second nozzle array 310 to provide a target amount of electrostatically charged droplets. The controller 314 can select the voltage so as to cause the one or more spray nozzles to provide a target amount of electrostatically charged droplets. For example, the target amount of electrostatically charged droplets can include an amount of electrostatically charged droplets that does not cause excess water to leave the first moisture panel 204 and the second moisture panel 206.

In some implementations, the controller 314 can be incorporated into a system level control device (such as a condensing unit rack controller) that is configured to operate the any or all other components of the system such as the evaporator, the compressor, the gas cooler, the receiver, and the expansion valve. For example, the controller 314 can be configured to operate the MT evaporators 12. The controller 314 can be configured to operate the LT evaporators 22. The controller 314 can be configured to operate the MT compressors 14. The controller 314 can be configured to operate the LT compressors 24. The controller 314 can be configured to operate the gas cooler/condenser 2. The controller 314 can be configured to operate the gas cooler 200. The controller 314 can be configured to operate the receiving tank 6. The controller 314 can be configured to operate the expansion valves 11.

Figure 4:
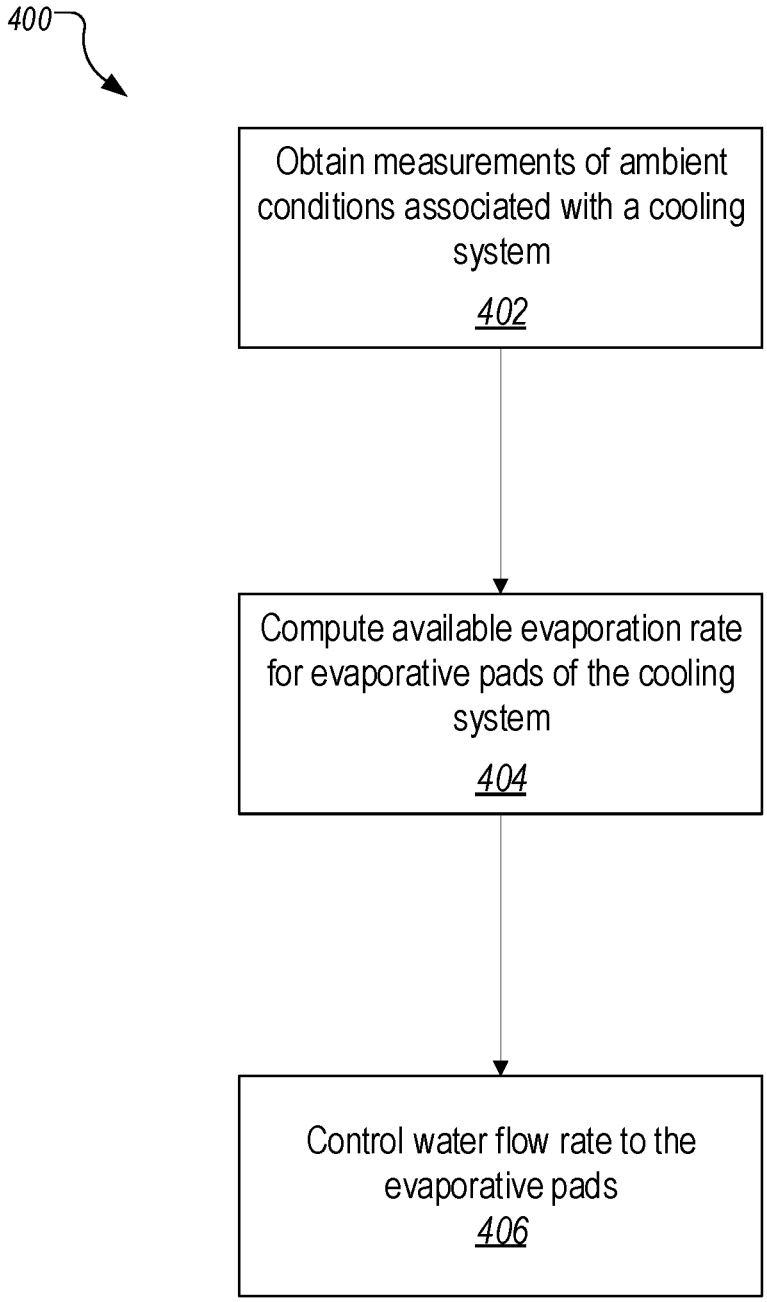
FIG. 4 is a flow diagram of a process of cooling that includes controlling a flow a water to evaporative pads, according to an exemplary implementation.

FIG. 4 is a flow diagram of a process 400 of cooling that includes controlling a flow of water to evaporative pads. Process 400 can commence with obtaining measurements representative of ambient conditions associated with the location of the cooling system (402). The ambient conditions can include ambient dry bulb temperature and relative humidity. In some implementations, the measured conditions are obtained using sensors included in the cooling system. In other implementations, the measured ambient conditions are obtained from an external source, such as by way of a real-time weather API.

Based on the ambient conditions, an available evaporation rate for one or more evaporative pads of the cooling system is computed (404). In some implementations, the ambient conditions are combined with other inputs associated with a data center, such as altitude or air flow rate. In some implementations, the available evaporation rate is based on a pad efficiency. The pad efficiency value be a fixed value or dynamically determined (for example, based on operating characteristics of the cooling system.)

Based on the determined available evaporation rate, the water flow rate to one or more evaporative pads is controlled (406). In some implementations, water flow rate is operated to maintain a setpoint. The setpoint can be selected to ensure that the evaporative pads are provided with the correct amount of water, and the pads are not overfed or underfed.

Figure 5:
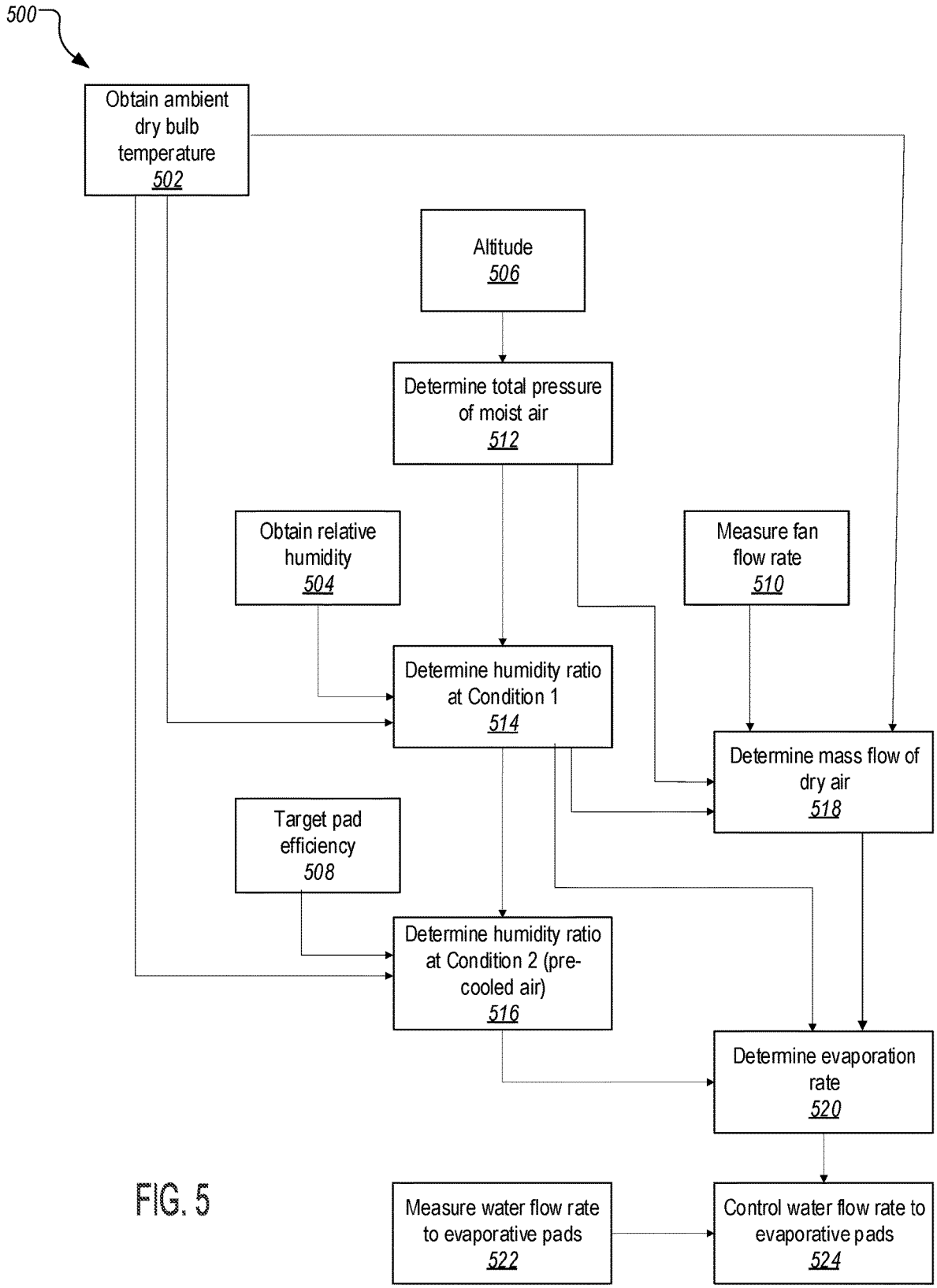
FIG. 5 is a flow diagram illustrating a process of controlling an adiabatic cooling system according to an exemplary implementation.

FIG. 5 is a flow diagram illustrating a process 500 of controlling an adiabatic cooling system according to an exemplary implementation. Process 500 includes obtaining values of ambient dry bulb temperature (502) and relative humidity (504). In some implementations, values of ambient dry bulb temperature and relative humidity are obtained by measurement.

Altitude (506) and target pad efficiency (508) are provided as input variables. Altitude 506 can correspond to a location above sea level. Target pad efficiency may be determined as further described herein. In some examples, pad efficiency can either be set as a fixed nominal number (e.g. 80%) or adaptive varying between a minimum to maximum value corresponding linearly to fan speed. Process 500 also includes measuring a fan airflow rate (510).

A total pressure of moist air is determined from the altitude (512). A humidity ratio for a first condition (Condition 1) is determined from the total pressure of moist air, relative humidity, and ambient dry bulb temperature (514).

A humidity ratio for a second condition (Condition 2) is determined from the target pad efficiency and the first humidity ratio (516). The second condition may correspond to pre-cooled air.

Based on the fan flow rate, total pressure of moist air, and the humidity ratio for the first condition, the mass flow dry air is determined (518).

Based on the humidity ratio for the second condition and the mass flow of dry air, an evaporation rate is determined (520). In some implementations, evaporation rate in gallons per minute is calculated from a volumetric evaporation rate.

The system can monitor water flow rate using a flow meter (522). Based on a calculated evaporation rate, the system can be operated to control the water flow rate to the evaporative pads (522). In some implementations, the water flow rate to the evaporative pads is adjusted based on periodic or continuous determination of an evaporation rate.

Example Computations

The following is an example of a set of computations that can be implemented to perform process 500. For illustrative purposes, the computations are described in terms of steps 1 through 14. Steps can, however, be performed in a different order. In addition, some of the steps can be omitted and/or other steps added.

Step 1.

Determine Pws from coefficients and measured $T_{ADB1}$ using Eq. 2

$$\ln(Pws) = C8/T + C9 + C10 \times T + C11 \times T^2 C12 \times T^3 + C13LN(T) \quad \text{(Eq.1a)}$$

$$Pws = e^{(C8/T+C9+C10\times T+C11\times T2+C12\times T3+C13LN(T))} \quad \text{(Eq.1b)}$$

where:

$$T = T_{ADB1} + 459.67$$

Coefficients: (ASHRAE-IP)

C8 −10440.397
C9 −11.29465
C10 −0.027022355
C11 1.28904E-05
C12 −2.47807E-09
C13 6.5459673

Step 2

Determine $Pw_1$ from Pws and measured RH using Eq. 1

$$Pw_1 = RH * Pws/100 \quad \text{(Eq.2)}$$

Step 3

Determine $P_{A1}$ from standard pressure at sea level and Input Altitude using Eq. 3

$$P_{A1} = 14.696 * (1 - 6.8754 * 10^{-6} * \text{Altitude})^{5.2559} \quad \text{(Eq.3)}$$

Step 4

Determine $\omega_{DB1}$ from $Pw_1$ and $P_{A1}$ using Eq. 4

$$\omega_{DB1} = 0.621945 * Pw_1 / (P_{A1} - Pw_1) \quad \text{(Eq.4)}$$

Step 5

Determine $h_{DB1}$ from measured $T_{ADB1}$ and calculated $\omega_{DB1}$ using Eq. 5

$$h_{DB1} = 0.24 * T_{ADB1} + \omega_{DB1} * (1061 + 0.444 * T_{ADB1}) \quad \text{(Eq.5)}$$

Step 6

Determine $T_{AWB1\text{-}i}$ iteratively (i=1→5) from measured $T_{ADB1}$, calculated $P_{WBisat}$ calculated $\omega_{WBisat}$ using Eq. 6a-6k (Newton-Raphson Technique)

Let (Eq.6a)

$$T_{AWB1-1} = T_{ADB1} - 5$$

$$P_{WBisat} = e^{(C8/T + C9 + C10 \times T + C11 \times T2 + C12 \times T3 + C13 LN(T))}$$

where:

$$T = T_{AWB1-i} + 459.67$$

$$\omega_{WBisat} = 0.621945 * (P_{WBisat} / (P_{A1} - P_{WBiast})) \quad \text{(Eq.6b)}$$

$$N_i = (1093 - 0.556 * T_{AWB1-i}) * \omega_{WBisat} - 0.24 * (T_{ADB-1} - T_{AWB1-i}) \quad \text{(Eq.6c)}$$

$$D_i = 1093 + 0.444 * T_{ADB1} - T_{AWB1-i} \quad \text{(Eq.6d)}$$

$$\omega_{WBipredicted} = N_i / D_i \quad \text{(Eq.6e)}$$

$$\omega_{WBiresidual} = \omega_{WBipredicted} - \omega_{DB1} \quad \text{(Eq.6f)}$$

$$dP_{WBisat} / dT_{AWB1-i} = P_{WBisat} * ((-C8) / T_{AWB1-i} * T_{AWB1-i}) + C10 + 2 * C11 * T_{AWB1-i} + 3 * C12 * T_{AWB1-i} * T_{AWB1-i} + C13 / T_{AWB1-i}) \quad \text{(Eq.6g)}$$

$$d\omega_{WBisat} / dT_{AWB1-i} = 0.621945 * ((P_{A1} - P_{WBisat}) * (dP_{WBisat} / dT_{AWB1-i}) + P_{WBisat} * (dP_{WBisat} / dT_{AWB1-i})) / ((P_{A1} - P_{WBisat}) * (P_{A1} - P_{WBisat})) \quad \text{(Eq.6h)}$$

$$dN_i = (1093 - 0.556 * T_{AWB1-i}) * (d\omega_{WBisat} / dT_{AWB1-i}) - 0.556 * \omega_{WBisat} + 0.24 \quad \text{(Eq.6i)}$$

$$d\omega_{WBiresidual} / dT_{AWB1-i} = (D_i * dN_i + N_i) / (D_i * D_i) \quad \text{(Eq.6j)}$$

$$T_{AWB1-i+1} = T_{AWB1-i} - \omega_{WBiresidual} / (d\omega_{WBiresidual} / dT_{AWB1-i}) \quad \text{(Eq.6k)}$$

Step 7

Determine $\Delta T_{ADB1\text{-}2}$ (wet bulb depression) from calculated $T_{AWB1\text{-}i}$, measured $T_{ADB1}$, and Target $\xi$ (Pad Efficiency) using Eq. 7

$$\Delta T_{ADB1-2} = \xi (T_{ADB1} - T_{AWB1-i}) \quad \text{(Eq.7)}$$

Step 8

Determine $T_{ADB2}$ (effective wet bulb) from calculated $\Delta T_{ADB1\text{-}2}$ and $T_{ADB2}$ using Eq. 8

$$T_{ADB2} = (T_{ADB1} - \Delta T_{ADB1-2}) \quad \text{(Eq.8)}$$

Step 9

Determine $\omega_{DB2}$ from calculated $T_{ADB2}$ and calculated $h_{DB1}$ using Eq. 9

$$\omega_{DB2} = (h_{DB1} - (0.24 * T_{ADB2})) / (1061 + 0.444 * T_{ADB2}) \quad \text{(Eq.9)}$$

Step 10

Determine $v_1$ from measured $T_{ADB1}$, calculated $\omega_{DB1}$ and calculated $P_{A1}$ using Eq. 10

$$v_1 = 0.370486 * (T_{ADB1} + 459.67) * (1 + 1.60785 * \omega_{DB1}) / P_{A1} \quad \text{(Eq.10)}$$

Step 11

Determine $\dot{m}_{DA}$ from measured Fan CFM, calculated $\omega_{DB1}$ and calculated $v_1$ using Eq. 11

$$\dot{m}_{DA} = (CFM) / v_1 \quad \text{(Eq.11)}$$

Step 12

Determine $\dot{m}_W$ (Evaporation rate) from calculated $\dot{m}_{DA}$, calculated $\omega_{DB1}$ and calculated $\omega_{DB2}$ using Eq. 12

$$\dot{m}_W = \dot{m}_{DA} * (\omega_{DB2} - \omega_{DB1}) \quad \text{(Eq.12)}$$

Step 13

Determine $V_W$=(Volumetric Evaporation rate) from calculated $\dot{m}_W$ and standard $\rho_{Water}$ using Eq. 13

$$V_W = \dot{m}_W / \rho_{Water} \quad \text{(Eq.13)}$$

where:

$$\rho_{Water} = 62.4 \text{ lb/ft}^3$$

Step 14

Convert to $GPM_W$ from calculated $V_W$ using Eq. 14

$$GPM_W = V_W / 0.13368 \quad \text{(Eq.14)}$$

Variable Declarations

Measured Variables

- RH Relative Humidity
- $T_{ADB1}$ Ambient Dry Bulb Temperature @ Condition 1
- Fan CFM Fan Flow Rate Input Variables

- Altitude Location Elevation above Mean Sea Level
- $\xi$ Target Pad Efficiency Calculated Variables

- $Pw_1$ Partial pressure of water vapor in air
- Pws Saturation pressure of water vapor @ Condition 1
- C8-C13 Heyland-Wexler coefficients for water vapor saturation pressure
- $P_{A1}$ Total Pressure of moist air (absolute pressure; i.e. total mixture pressure)
- $\omega_{DB1}$ Humidity ratio @ Condition 1
- $h_{DB1}$ Specific Enthalpy of moist air @ Condition 1

$P_{WBisat}$ Saturation pressure of water vapor @ iteration i wet bulb temperature $\omega_{WBisat}$ Humidity ratio of moist air at saturation @ iteration i wet bulb temperature $N_i$ Degree of saturation @ iteration i wet bulb temperature $D_i$ Enthalpy of water vapor at saturation @ iteration i wet bulb temperature $\omega_{WBipredicted}$ Humidity Ratio @ iteration i wet bulb temperature $\omega_{WBiresidual}$ Humidity Ratio Differential between $\omega_{WBipredicted}$ and $\omega_{DB1}$ @ iteration i wet bulb temperature $dP_{WBisat}/dT_{AWB1-i}$ Derivative of $P_{WBisat}$ with respect to $T_{AWB1-i}$ @ iteration i wet bulb temperature $d\omega_{WBisat}/dT_{AWB1-1}$ Derivative of $\omega_{WBisat}$ with respect to $T_{AWB1-i}$ @ iteration i wet bulb temperature $d_{Ni}$ Degree of saturation differential @ iteration i wet bulb temperature $d\omega_{WBiresidual}/dT_{AWB1-i}$ Derivative of $\omega_{WBiresidual}$ with respect to $T_{AWB1-i}$ @ iteration i wet bulb temperature $T_{AWB1-i+1}$ Wet bulb temperature @ iteration i $\Delta T_{ADB1-2}$ Wet bulb depression $T_{ADB2}$ Effective wet bulb temperature (Pre-cooled air dry bulb temperature)

$\omega_{DB2}$ Humidity ratio @ Condition 2 (Pre-cooled air)

$v_1$ Specific volume of moist air @ Condition 1

$\dot{m}_{DA}$ Mass flow of dry air $\dot{m}_W$ Mass flow of water vapor from Condition 1 to Condition 2 (Evaporation rate)

$V_W$ Volumetric flow rate (Evaporation rate)

$GPM_W$ Evaporation Rate

In some implementations, water flow rate is a process variable. The control variable is the setpoint and equals the calculated GPMw Evaporation Rate. The system monitors the feedback from the water flow metering device and adjusts the water flow through valve(s) so that the water flow rate equals the evaporation rate setpoint.

In some implementations, pad efficiency values used to control water flow are adjusted dynamically. In one implementation, the current pad efficiency is determined from a base efficiency using the evaluation of target water supply rate and measuring effective wet bulb temperature (e.g., pre-cooled dry bulb temperature) or indicating runoff signally possible overfeed condition.

Figure 6:
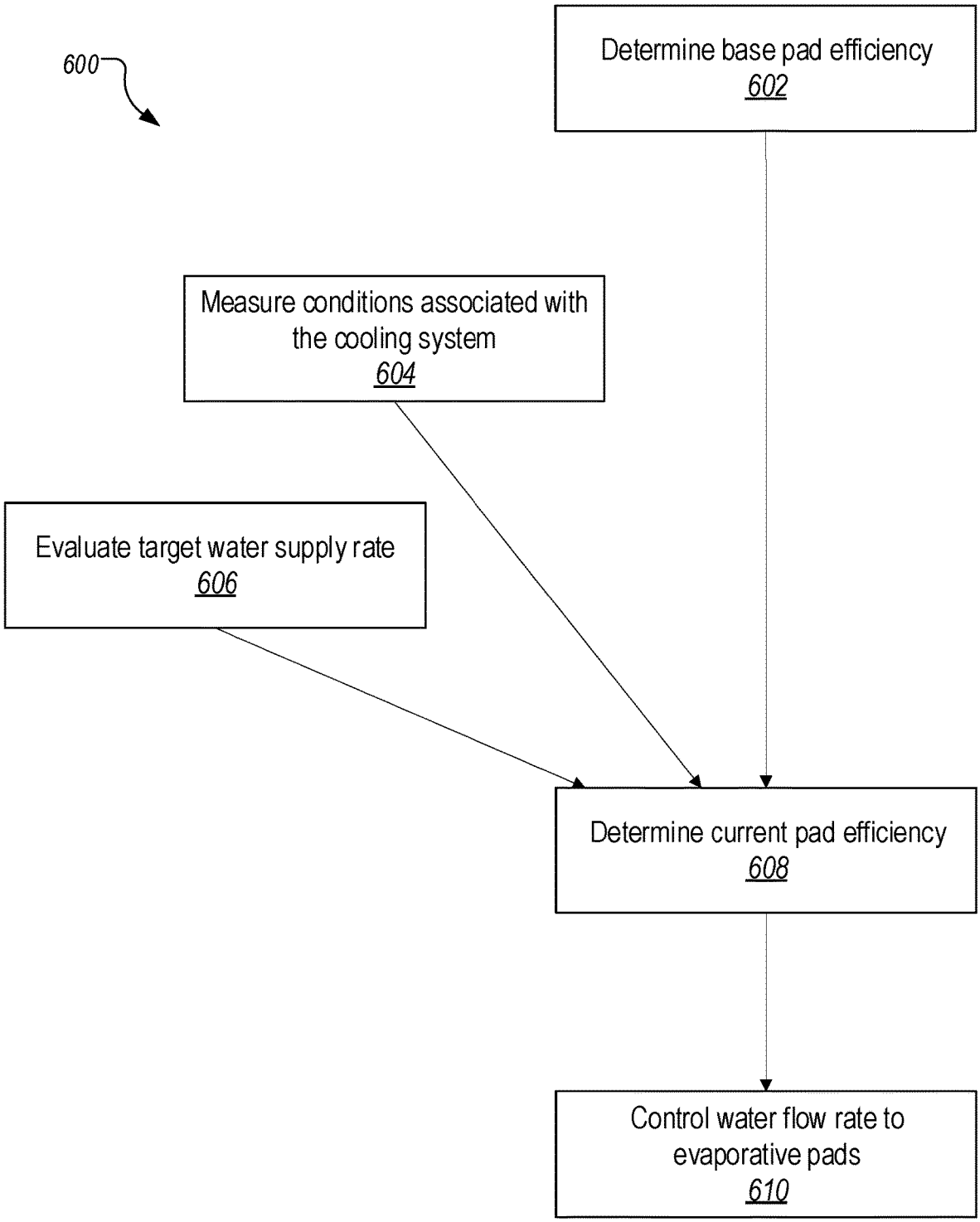
FIG. 6 is a flow diagram of a process that includes dynamically determining pad efficiency, according to an exemplary implementation.

FIG. 6 is a flow diagram of a process 600 that includes dynamically determining pad efficiency of a cooling unit. Initially, a base pad efficiency is determined (602). The base pad efficiency can be determined based on characteristics of the pads (e.g., physical characteristics such as material and size), characteristics of the system in which the pads are installed, and or characteristics or conditions of the operating environment for the system.

Measurements are taken of conditions in or around the cooling system (604). The measurements can include indicators of current moisture levels and/or water feed conditions in the system. In one implementation, an effective wet bulb temperature (pre-cooled dry bulb temperature) is computed from measurements. In another implementation, one or more indicators of runoff are detected. A target water supply rate can be evaluated (606). From the target water supply rate and the measurements, a current pad efficiency is determined from the base efficiency (608). The current pad efficiency is used in controlling water flow to the evaporative pads (610). In some implementations, the current pad efficiency is used to determine an evaporation rate and control water flow to an adiabatic cooling unit in the manner described above for process 500 with respect to FIG. 5.

Example Pad Efficiency Computation

In one example, target pad efficiency $\xi$ is determined by calculation from a linear range of maximum to minimum efficiency in relation to fan speed Fan CFM. An example set of equations is as follows:

$$\xi SLOPE = (\xi\min - \xi\max)/CFM\max - CFM\min) \quad \text{(Eq.1)}$$

$$\xi OFFSET = (\xi\min - (\xi SLOPE * CFM\max) \quad \text{(Eq.2)}$$

$$\xi = (\text{Fan } CFM * \xi SLOPE) + \xi OFFSET \quad \text{(Eq.3)}$$

In various implementations described above, water flow to an evaporative cooling system is controlled using measurement of ambient conditions for the cooling system. Control of a flow of water to an evaporative cooling system can, however, be based on other inputs. For example, in certain implementations, application rate is controlled by measuring run-off water and adjusting flow rate based on resulting measurement, or by applying water at a constant rate without regard to water run-off (waste).

Information from measured ambient conditions can be combined with information from sensors that measure moisture or water conditions in a cooling unit. For example, in certain implementations, one or more moisture sensors 330 are configured to provide a signal representative of the first moisture level from the first moisture panel 204 and/or second moisture panel 206. A first moisture sensor can be configured to provide the signal representative of the first moisture level from a first moisture pad of the one or more moisture pads. A second moisture sensor can be configured to provide a signal representative of a second moisture level from a second moisture pad of the one or more moisture pads.

In some implementations, the moisture sensors can be configured to provide the signal representative of the moisture level from at least one of a bottom of the first moisture panel or a bottom of the second moisture panel. For example, moisture sensor 330 can be configured to provide the signal representative of the moisture level from the bottom of the first moisture panel 204 and/or from the bottom of the second moisture panel 206. A moisture sensor can be configured to provide the signal representative of the moisture level from a bottom of the one or more moisture pads. In certain implementations, the moisture sensor is configured to provide the signal representative of the moisture level from a drainage receptacle disposed beneath the first moisture panel and/or the second moisture panel.

In certain implementations, the controller 314 can receive a signal representative of the first moisture level and compare the signal to a benchmark value. For example, the benchmark value can represent an adequately wetted (e.g., not over-wetted and not under-wetted) first moisture panel 204. The controller 314 can determine that the first moisture level is greater than, less than, or equal to the benchmark value. The controller 314 can be configured to receive the signal representative of the first moisture level from the first moisture pad. The controller 314 can receive a signal representative of the first moisture level and determine if the signal is within a range (e.g., 2%, 5%, 10%, etc.) of a target moisture level.

In some implementations described above, a psychometric model is employed to control water flow to the pads of an electrostatically charged adiabatic system. Systems and methods of water flow control and cooling can, however, be employed in other types of cooling systems. For example, in some implementations, methods described herein are implemented in a drip adiabatic system.

The construction and arrangement of the elements of the refrigeration system with an adiabatic electrostatic gas cooler as shown in the exemplary implementations are illustrative only. Although only a few implementations have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied, and the nature or number of discrete elements or positions may be altered or varied. Accordingly, all such modifications are intended to be included within the scope of the present disclosure. The order or sequence of any process or method steps may be varied or re-sequenced according to alternative implementations. Other substitutions, modifications, changes, and omissions may be made in the design, operating conditions and arrangement of the exemplary implementations without departing from the scope of the present disclosure.

The present disclosure contemplates methods, systems, and program products on any machine-readable media for accomplishing various operations. The implementations of the present disclosure may be implemented using existing computer processors, or by a special purpose computer processor for an appropriate system, incorporated for this or another purpose, or by a hardwired system. Implementations within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can include RAM, ROM, EPROM, EEPROM, CD-ROM or other optical disk storage, magnetic disk storage or other magnetic storage devices, or any other medium that can be used to carry or store desired program code in the form of machine-executable instructions or data structures and that can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data that cause a general-purpose computer, special purpose computer, or special purpose processing machines to perform a certain function or group of functions.

Although the figures show a specific order of method steps, the order of the steps may differ from what is depicted. Two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps.

Any references to implementations or elements or acts of the systems and methods herein referred to in the singular can include implementations including a plurality of these elements, and any references in plural to any implementation or element or act herein can include implementations including only a single element. References in the singular or plural form are not intended to limit the presently disclosed systems or methods, their components, acts, or elements to single or plural configurations. References to any act or element being based on any information, act or element may include implementations where the act or element is based at least in part on any information, act, or element.

Any implementation disclosed herein may be combined with any other implementation, and references to "an implementation," "some implementations," "an alternate implementation," "various implementations," "one implementation" or the like are not necessarily mutually exclusive and are intended to indicate that a particular feature, structure, or characteristic described in connection with the implementation may be included in at least one implementation. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Elements other than 'A' and 'B' can also be included.

The systems and methods described herein may be embodied in other specific forms without departing from the characteristics thereof. The foregoing implementations are illustrative rather than limiting of the described systems and methods.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

The systems and methods described herein may be embodied in other specific forms without departing from the characteristics thereof. The foregoing implementations are illustrative rather than limiting of the described systems and methods. Scope of the systems and methods described herein is thus indicated by the appended claims, rather than the foregoing description, and changes that come within the meaning and range of equivalency of the claims are embraced therein.

What is claimed is:

1. A method of operating a cooling system having one or more evaporative pads, the method comprising:

obtaining measurements of one or more ambient conditions associated with the cooling system;

determining, based on (i) a target water supply rate, (ii) a base efficiency of at least one of the one or more evaporative pads, and (iii) an effective wet bulb temperature associated with the at least one of the one or more evaporative pads, a current pad efficiency of the at least one of the of the one or more evaporative pads;

determining, based at least in part on (i) the one or more ambient conditions, and (ii) the current pad efficiency of at least one of the one or more evaporative pads, an available evaporation rate of at least one of the one or more evaporative pads; and controlling, based at least in part on the available evaporation rate, an application rate of water to at least one of the one or more evaporative pads.

2. The method of claim 1, wherein controlling the application rate comprises:

selecting a setpoint for the application rate based at least in part on the available evaporation rate; and adjusting the application rate to maintain the setpoint.

3. The method of claim 1, further comprising sensing an airflow through a portion of the cooling system, wherein the available evaporation rate is determined, at least in part, based on a rate of the airflow.

4. The method of claim 1, wherein the target water supply rate comprises a target supply of water provided to the at least one of the one or more evaporative pads.

5. The method of claim 1, wherein:

obtaining measurements of the one or more ambient conditions associated with the cooling system comprises measuring relative humidity and dry bulb temperature; and the available evaporation rate is determined in part based on the relative humidity and dry bulb temperature.

6. The method of claim 1, wherein obtaining measurements of the one or more ambient conditions associated with the cooling system comprises receiving weather information data.

7. The method of claim 1, further comprising:

measuring a moisture level associated with at least one of the one or more evaporative pads, and adjusting, based at least in part on the measured moisture level, the water application rate.

8. The method of claim 1, further comprising:

measuring a water level associated with run-off from at least one of the one or more evaporative pads, and adjusting, based at least in part on the measured water level, the water application rate.

9. The method of claim 1, wherein the cooling system comprises a $CO_2$ refrigeration system.

10. The method of claim 1, wherein the one or more evaporative pads are included in an electrostatic adiabatic cooling system.

11. The method of claim 1, wherein the one or more evaporative pads are included in a drip adiabatic cooling system.

12. The method of claim 1, further comprising adjusting a pad efficiency based on one or more measurements taken during operation of the cooling system, wherein the available evaporation rate is based at least in part on the adjusted pad efficiency.

13. The method of claim 1, wherein determining available evaporation rate comprises determining, based at least in part of the measured conditions, a humidity ratio for one or more conditions of the cooling system.

14. A cooling system, comprising:

one or more heat exchanger coils;

one or more evaporative pads external to the one or more heat exchanger coils;

one or more nozzle assemblies external to the one or more evaporative pads and configured to provide water to at least one of the one or more evaporative pads;

one or more cooling system sensors, each cooling system sensor configured to provide a signal representative of an operating characteristic of the cooling system;

one or more ambient sensors each configured to provide a signal representative of one or more ambient conditions associated with the cooling system; and a controller communicatively coupled to at least one of the one or more ambient sensors and the one or more cooling system sensors, the controller configured to:

receive the signal representative of at least one of the one or more ambient conditions and the signal representative of the operating characteristic of the cooling system;

determine, based on (i) a target water supply rate, (ii) a base efficiency of at least one of the one or more evaporative pads, and (iii) an effective wet bulb temperature associated with the at least one of the one or more evaporative pads and associated with the operating characteristics of the cooling system, a current pad efficiency of the at least one of the of the one or more evaporative pads; and control a supply of water to the at least one of the one or more evaporative pads in response to the signal representative of the one or more ambient conditions and the current pad efficiency.

15. The system of claim 14, wherein:

at least one of the ambient sensors comprises a temperature sensor, and the signal is representative of a dry bulb temperature.

16. The system of claim 14, wherein:

at least one of the ambient sensors comprises a relative humidity sensor, and the signal is representative of a relative humidity.

17. The system of claim 16, wherein at least one of the ambient sensors comprises a temperature sensor and the signal is further representative of a dry bulb temperature, and the controller is further configured to determine, based in part on the dry bulb temperature and the relative humidity, an available evaporation rate for the at least one evaporative pad.

18. The system of claim 14, wherein the controller is further configured to determine, based in part on measured dry bulb temperature, measured relative humidity, and the pad efficiency, an available evaporation rate for the at least one evaporative pad.

19. The system of claim 14, wherein:

the controller is configured to determine an adjustment to a pad efficiency of the at least one evaporative pad based on one or more conditions associated with the cooling system, and the supply of water to the at least one evaporative pad is controlled in part in response to an adjusted pad efficiency.

20. The system of claim 14, further comprising:

a fan configured to move air through at least a portion of the cooling system; and an airflow sensor configured to provide a signal representative of an air flow rate associated with the fan, wherein the supply of water to the at least one evaporative pad is controlled in part in response to the signal representative of the air flow rate.

21. The system of claim 14, wherein the controller is further configured to determine, based in part on the flow rate, an available evaporation rate for the at least one evaporative pad.

22. The system of claim 14, further comprising:

a moisture sensor configured to provide a signal representative of a moisture level associated with the at least one evaporative pad, wherein the supply of water to the at least one evaporative pad is controlled in part in response to the signal representative of the moisture level.

23. The system of claim 14, further comprising a weather application program interface coupled to the controller, wherein the controller is configured to control a supply of water to the at least one evaporative pad based in part on weather information received by way of the weather application program interface.

24. A cooling system controller, comprising: one or more hardware processors; and a computer storage medium communicatively coupled to the one or more hardware processors, the computer storage medium comprising instructions that, when executed by the one or more hardware processors, cause the one or more hardware processors to perform operations comprising: obtaining measurements of one or more ambient conditions associated with a cooling system; determining, based on (i) a target water supply rate, (ii) a base efficiency of at least one of a plurality of evaporative pads of the cooling system, and (iii) an effective wet bulb temperature associated with the at least one of the one or more evaporative pads, a current pad efficiency of the at least one of the of the one or more evaporative pads; determining, based in part on (i) the one or more ambient conditions, and (ii) the current pad efficiency of at least one of the one or more evaporative pads, an application rate setpoint; and controlling a flow of water to at least one of the one or more evaporative pads to maintain the application rate setpoint.

25. The cooling system controller of claim 24, wherein determining the application rate setpoint comprises determining, based at least in part on the ambient conditions, an available evaporation rate at least one of the one or more evaporative pads, wherein the application rate setpoint is determined at least in part from the available evaporation rate.

26. The cooling system controller of claim 24, wherein the operations further comprise sensing an airflow through a portion of the cooling system, and the application rate setpoint is determined, at least in part, based on a rate of the airflow.

27. The cooling system controller of claim 24, wherein the one or more ambient conditions comprise a dry bulb temperature and a relative humidity.

28. The cooling system controller of claim 24, wherein obtaining measurements of the one or more ambient conditions comprises receiving weather information data.

29. A method of operating a cooling system having one or more evaporative pads, comprising:

determining a base efficiency for at least one of the one or more evaporative pads;

obtaining measurements of one or more conditions associated with the cooling system while the cooling system is operating;

determining, based at least in part on (i) the measurements of the one or more conditions and (ii) the base efficiency, one or more adjustments to the base efficiency of at least one of the one or more evaporative pads;

determining a current pad efficiency based on (i) the one or more adjustments to the base efficiency, (ii) a target water supply rate, and (iii) an effective wet bulb temperature associated with the at least one of the one or more evaporative pads; and controlling, based at least in part on the current pad efficiency, an application rate of water to at least one of the one or more evaporative pads.

30. The method of claim 29, wherein determining the current pad efficiency comprises determining a target pad efficiency.

31. The method of claim 29, further comprising determining an available evaporation rate for at least one of the evaporative pads based in part on the current pad efficiency, wherein the application rate of water is controlled based on the available evaporation rate.

* * * * *